US007939775B2

(12) United States Patent
Kim

(10) Patent No.: US 7,939,775 B2
(45) Date of Patent: May 10, 2011

(54) BUTTON UNIT FOR ELECTRONIC CONTROL APPARATUS OF VEHICLE

(75) Inventor: Eung Young Kim, Anyang-si (KR)

(73) Assignee: Kia Motors Corporation, Seoul (KR)

( * ) Notice: Subject to any disclaimer, the term of this patent is extended or adjusted under 35 U.S.C. 154(b) by 692 days.

(21) Appl. No.: 11/942,434

(22) Filed: Nov. 19, 2007

(65) Prior Publication Data

US 2009/0020401 A1 Jan. 22, 2009

(30) Foreign Application Priority Data

Jul. 18, 2007 (KR) ..... 10-2007-0071734

(51) Int. Cl.
*H01H 25/00* (2006.01)

(52) U.S. Cl. ..... 200/332; 200/339

(58) Field of Classification Search ..... 200/329–332, 200/335–341, 5 R, 6 A, 17 R
See application file for complete search history.

(56) References Cited

FOREIGN PATENT DOCUMENTS

| | | |
|---|---|---|
| EP | 471317 A2 * | 2/1992 |
| JP | 09-185920 | 7/1997 |
| JP | 10-269903 | 10/1998 |

* cited by examiner

*Primary Examiner* — Renee Luebke
*Assistant Examiner* — Marina Fishman
(74) *Attorney, Agent, or Firm* — Morgan, Lewis & Bockius LLP

(57) ABSTRACT

A button unit for an electronic control apparatus of a vehicle is disclosed. The button unit comprises a button and a detector. The button comprises a controlling portion which is pivotably coupled to a front panel of the electronic control apparatus, and an extension bar which extends from the controlling portion into the electronic control apparatus to be pivoted in a direction opposite to the pivoting direction of the controlling portion. The detector comprises a switch which is located within a pivoting radius of the extension bar and can be pivoted under the action of the extension bar, and a detector body on which the switch is pivotably installed and configured to transmit at least a electrical signal to the outside according to pivoting angles of the switch.

9 Claims, 4 Drawing Sheets

BUTTON UNIT FOR ELECTRONIC CONTROL APPARATUS OF VEHICLE

CROSS-REFERENCE TO RELATED APPLICATIONS

This application claims priority to Korean Application No. 10-2007-0071734, filed on Jul. 18, 2007, the disclosure of which is incorporated herein by reference.

BACKGROUND OF THE INVENTION

1. Field of the Invention

The present invention relates to a button unit for an electronic control apparatus of a vehicle, and, more particularly, to a button unit which has a simple structure and a reduced manufacturing cost.

2. Description of the Prior Art

Usually, electronic control apparatuses for an audio system and for an air conditioning system are installed on the center fascia panel. Button units for power on/off and for controlling the operation of the apparatus are installed on the front panel of the electronic control apparatus.

FIG. 1 illustrates an example of a conventional air conditioning control apparatus 1. Button units 2 and 3 are installed on the front panel of the air conditioning control apparatus 1. The amount of air flow and the temperature can be adjusted using the button units 2 and 3. In FIG. 1, if the upper ends of the button units 2 and 3 are pressed, the amount of air flow and the temperature are increased, and if the lower ends of the button units 2 and 3 are pressed, the amount of air flow and the temperature are decreased. Each of these button units 2 and 3 employs the elasticity of a spring or the compressibility of rubber, and is usually called a tack switch. This example is provided in reference to JP2001-210192A (2001 Aug. 3), JP2001-266712A (2001 Sep. 28).

However, the conventional button unit suffers from some defects in that the structure thereof is complicated and the manufacturing cost thereof is increased.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

Accordingly, the present invention has been made keeping in mind the above problems occurring in the prior art, and is directed to provide a button unit for an electronic control apparatus of a vehicle which has a simple structure and a reduced manufacturing cost.

In order to achieve the above improvement, hence, the present invention is directed to a button unit for an electronic control apparatus of a vehicle comprising a button having a characterizing structure and a detector for sensing the operation of the button.

The button has a controlling portion which is pivotably coupled to a front panel of the electronic control apparatus, and an extension bar which extends from the controlling portion into the electronic control apparatus to be pivoted in a direction opposite to the pivoting direction of the controlling portion.

The detector comprises a switch which is located within a pivoting radius of the extension bar and can be pivotally rotated under the action of the extension bar, and a detector body on which the switch is pivotably installed and configured to transmit at least a electrical signal to the outside according to pivoting angles of the switch.

In the present invention, it can be envisaged that the switch and the extension bar can be operatively coupled with each other by a link element.

The switch must be configured in such a way as to be moved in an interlocked manner with the movement of the extension bar. An open portion is defined on the distal end of the extension bar, and the distal end of the switch is inserted into the open portion so as to interfere with the extension bar. Preferably, a fork portion is formed on the distal end of the extension bar, and the distal end of the switch is positioned between tines of the fork portion.

It is preferred that the switch has at least an inclined slide portion so that the extension bar can slide on the inclined slide portion when the extension bar operates the switch. From this fact, the damage and wear of component elements attributable to the interference between the switch and the extension bar can be reduced. The switch may have a shape in which the width thereof gradually decreases toward the distal end of the switch.

The controlling portion has a knob which is formed protrusively so as to allow a user's convenient manipulation of the controlling portion. In particular, the controlling portion can be pivoted in upward and downward directions, and the knob extends in a horizontal direction to allow the controlling portion to be conveniently manipulated by the user.

It is preferred that the detector body be configured such that it has different contact points conforming to pivoting angles of the switch. By causing non-continuous contact points to be formed in this mechanical way, the structure of the button unit can be made simple and compact. For example, the electrical signal values corresponding to the contact points are transmitted to the control section of the electronic control apparatus.

The above features and advantages of the present invention will be apparent from or are set forth in more detail in the accompanying drawings, which are incorporated in and form a part of this specification, and the following Detailed Description of the Invention, which together serve to explain by way of example the principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
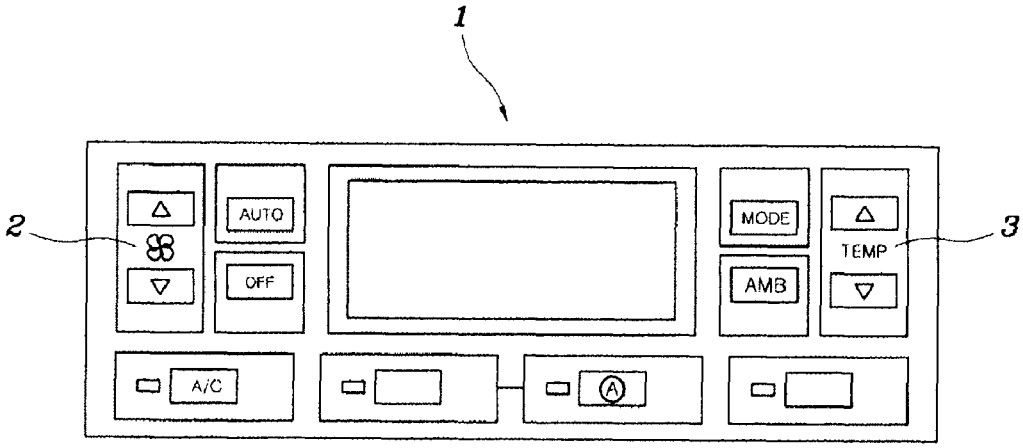
FIG. 1 is a schematic view illustrating the front panel of a conventional air conditioning control apparatus.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Figure 2:
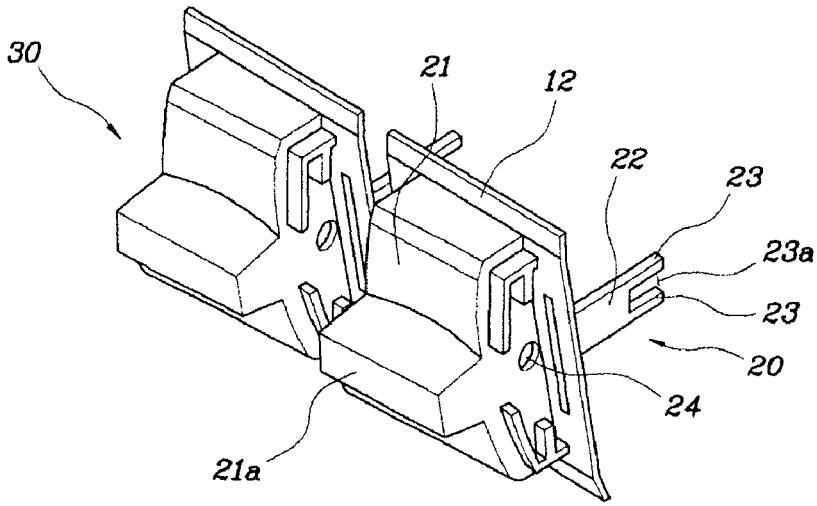
FIG. 2 is an enlarged perspective view illustrating the buttons of a button unit in accordance with an embodiment of the present invention.
Figure 5:
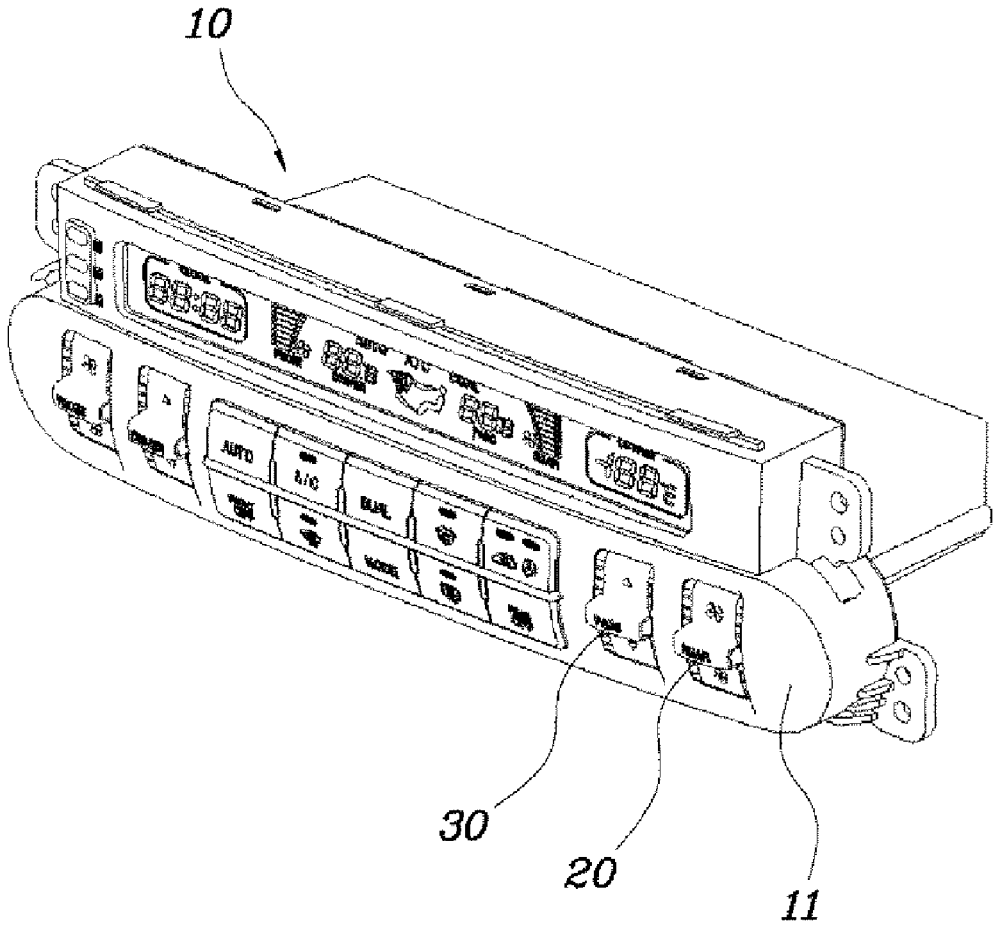
FIG. 5 is a side view illustrating an air conditioning control apparatus to which the button unit according to the present invention is applied.

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims The buttons 20 and 30 of a button unit in accordance with a preferred embodiment of the present invention will be described with reference to FIGS. 2 and 5.

The button 20 includes a controlling portion 21 which is installed on the front panel 11 of an air conditioning control apparatus 10 by means of a bracket 12, and an extension bar 22 which extends into the air conditioning control apparatus 10. The button 20 is capable of rotary movement about an axis of a rotary shaft hole 24 in upward and downward directions. Therefore, if the controlling portion 21 of the button 20 is pushed upward, the extension bar 22 is moved downward and if the controlling portion 21 of the button 20 is pushed downward, the extension bar 22 is moved upward.

The controlling portion 21 of the button 20 is installed in the bracket 12 and is received in the operating (not shown) of the bracket 12. The controlling portion 21 of the button 20 projects outward to be manipulated by a user. A knob 21*a* is projectedly formed on the outer surface of the controlling portion 21. The knob 21*a* extends in the horizontal direction along the axis of a rotary shaft 24 so as to improve convenience when manipulating the controlling portion 21, which is moved in upward and downward directions.

The extension bar 22 of the button 20 extends from the rear surface of the controlling portion 21, in particular, from the point where the rotary shaft hole 24 is positioned, into the air conditioning control apparatus 10. When the controlling portion 21 is pivoted about the axis of rotary shaft hole 24, the extension bar 22 is pivoted in the direction opposite to the pivoting direction of the controlling portion 21. That is to say, if the controlling portion 21 is rotated downward, the extension bar 22 is rotated upward, and if the controlling portion 21 is rotated downward, the extension bar 22 is rotated downward. A fork portion 23 having two tines, which are separate from and located opposite each other, is formed on the distal end of the extension bar 22, and the distal end of a switch, which will be described below, is inserted into the open portion 23*a* defined between the tines of the fork portion 23.

The rotary shaft hole 24 is pivotably fixed to the front panel 11 or the frame of the air conditioning control apparatus 10.

Figure 3:
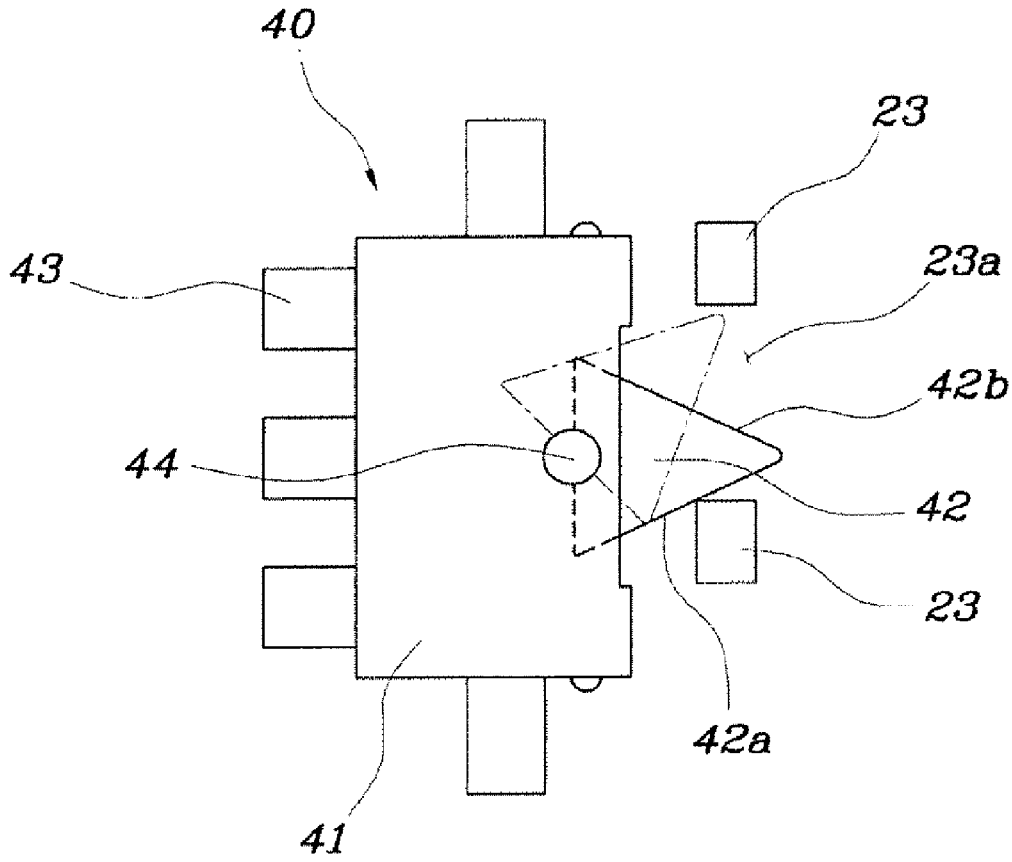
FIG. 3 is a plain view illustrating the detector of the button unit according to the present invention.
Figure 4:
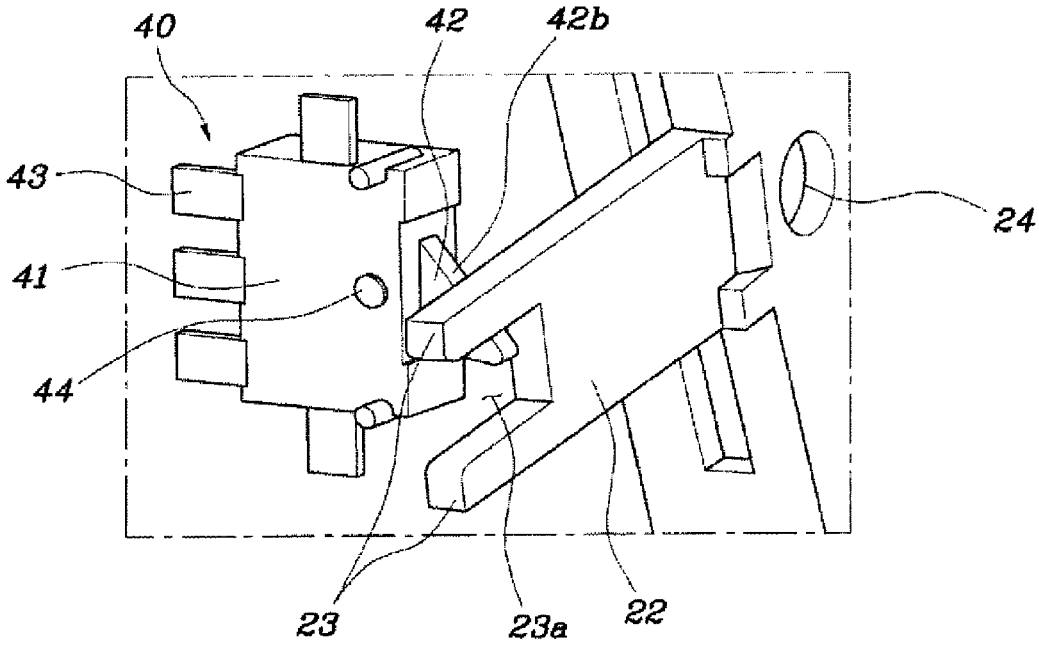
FIG. 4 is an exploded perspective view depicting the operation structure of the button unit according to the present invention.

The detector 40 of the button unit in accordance with the preferred embodiment of the present invention will be described with reference to FIGS. 3 and 4.

The detector 40 is composed of a switch 42 and a detector body 41, on which the switch 42 is pivotably installed.

First, the switch 42 is located within the pivoting radius of the fork portion 23, so that, when the extension bar 22 is pivoted about the axis of rotary shaft hole 24, the switch 42 can be operated by the fork portion 23. As the extension bar 22 is pivoted about the axis of rotary shaft hole 24, the switch 42 executes rotary movement about a rotary shaft 44 in upward and downward directions in accordance with the motion of the extension bar 22. The rotary shaft 44 pivotably connects the switch 42 and the detector body 41. The pivoting direction of the switch 42 is the same as that of the extension bar 22. The switch 42, as an exemplary embodiment, has inclined slide portions 42*a* and 42*b*. As shown in FIG. 4, when the extension bar 22 moves the switch 42 upwards, the lower tine of the extension bar 22 slides upwards on the inclined slide portion 42*a* of the switch 42. As the extension bar 22 moves the switch 42 downwards, the upper tine of the extension bar 22 slides downwards on the inclined slide portion 42*b* of the switch 42. The width of the switch 42 gradually decreases toward the distal end of the switch 42. In this regard, as shown in FIG. 3, the switch 42 has the sectional shape of a triangle.

The detector body 41 serves as a member on which the switch 42 is pivotably installed, and transmits various electrical signals conforming to the pivoting angles of the switch 42. The rotary shaft 44 is installed on the detector body 41, and an electric circuit, which has contact points conforming to the pivoting angles of the switch 42, is provided in the detector body 41. The electric circuit, which has the contact points conforming to the pivoting angles of the switch 42, can be designed in a variety of ways, as in the conventional art. The contact points are connected to leads 43 such that the electrical signals corresponding to the respective contact points can be transmitted to the printed circuit board (not shown) or the micro computer of the air conditioning control apparatus 10, which is connected to the leads 43.

As described above, in the button unit according to the present embodiment, since button manipulation signals can be sensed using one switch, the button unit has a simple structure, and the manufacturing cost thereof can be reduced.

As is apparent from the above description, the button unit for an electronic control apparatus of a vehicle according to the present invention provides advantages in that the button unit has a simple structure and the manufacturing cost can be reduced while achieving the same level of responsiveness as in the conventional art.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A button unit for an electronic control apparatus of a vehicle, comprising:

a button having a controlling portion which is pivotably coupled to a front panel of the electronic control apparatus, and an extension bar extending from the controlling portion into the electronic control apparatus wherein the extension bar moves in a direction opposite to the direction of the controlling portion as the button pivots; and a detector having a switch which is located within a pivoting radius of the extension bar and is pivoted under the action of the extension bar, and a detector body on which the switch is pivotably installed and configured to transmit a plurality of electrical signals to the outside according to a plurality of angles of the switch;

wherein the button and the switch pivot about orthogonal axes.

2. The button unit according to claim 1, wherein the electronic control apparatus is an air conditioning control apparatus.

3. The button unit according to claim 1, wherein an open portion is defined on a distal end of the extension bar, and a distal end of the switch is inserted into the open portion so as to interfere with the extension bar.

4. The button unit according to claim 3, wherein a fork portion comprising at least a tine is formed on the distal end of the extension bar and the distal end of the switch is positioned between the tines of the fork portion.

5. The button unit according to claim 1, wherein the switch has at least an inclined slide portion so that the extension bar can slide on the inclined slide portion when the extension bar operates the switch.

6. The button unit according to claim 5, wherein the switch has a shape in which a width gradually decreases toward the distal end of the switch.

7. The button unit according to claim 1, wherein the controlling portion has a knob protrudes from the controlling portion to allow convenient manipulation of the controlling portion.

8. The button unit according to claim 7, wherein the controlling portion can be pivoted upward and downward, and the knob extends in a horizontal direction.

9. The button unit according to claim 1, wherein the detector body is configured such that it has at least a contact point conforming to respective pivoting angles of the switch.

* * * * *